United States Patent [19]

Hanyu et al.

[11] Patent Number: 4,466,368

[45] **Date of Patent: * Aug. 21, 1984**

[54] LOCK STITCHING SEWING MACHINE WITH A THREAD TIGHTENING DEVICE

[75] Inventors: Susumu Hanyu; Kazumasa Hara; Mikio Koike, all of Tokyo, Japan

[73] Assignee: Janome Sewing Machine Co. Ltd., Tokyo, Japan

[ * ] Notice: The portion of the term of this patent subsequent to Jul. 20, 1999 has been disclaimed.

[21] Appl. No.: 370,123

[22] Filed: Apr. 20, 1982

Related U.S. Application Data

[63] Continuation of Ser. No. 158,779, Jun. 12, 1980, Pat. No. 4,340,003.

[30] Foreign Application Priority Data

Jun. 20, 1979 [JP] Japan ..... 54-76721

[51] Int. Cl.[3] ..... D05B 57/08

[52] U.S. Cl. ..... 112/191; 112/254; 112/314; 112/158 A

[58] Field of Search ..... 112/158 A, 158 R, 158 B, 112/158 D, 314, 254, 255, 191

[56] References Cited

U.S. PATENT DOCUMENTS 4,340,003 7/1982 Hanyu et al. ..... 112/191

*Primary Examiner*—Peter P. Nerbun

*Attorney, Agent, or Firm*—Michael J. Striker

[57] ABSTRACT

A thread tightening device for a sewing machine of the type having a main shaft, a vertically reciprocable needle bar with a needle carrying an upper thread, a loop taker and a drive shaft for driving the loop taker and a feed dog; the thread tightening device includes a group of pattern cams operatively connected to the main shaft, pattern selecting device and an arrangement for controlling the vertical movement of the feed dog. This arrangement comprises a control cam and a rotatable shaft, the control cam being slidably axially mounted on the rotatable shaft but not turnable with respect to the shaft. The thread tightening device also includes an element arranged for vertical reciprocating movement in a timed relation with the feed dog, which element engages a lower thread during the stitching operation of the sewing machine. A thread tension adjusting device is provided in the machine, which comprises an adjusting cam operatively connected to the pattern cams and a linkage arrangement which is operatively connected to the adjusting cam and to the control cam to displace the control cam in the axial direction in response to a set position of the adjusting cam to thereby adjusting lower thread tension in accordance with the respective pattern cam.

10 Claims, 16 Drawing Figures

LOCK STITCHING SEWING MACHINE WITH A THREAD TIGHTENING DEVICE

CROSS-REFERENCE TO A RELATED APPLICATION

This application is a continuation of the application Ser. No. 158,779 filed June 12, 1980 now U.S. Pat. No. 4,340,003.

BACKGROUND OF THE INVENTION

The invention relates to sewing machines for producing various stitch patterns including a pattern of straight stitches, and more particularly relates to a thread tightening device for such sewing machines, which are operated to provide a most suitable formation of stitches (the interlocking conditions of the upper and lower threads) in accordance with the patterns to be selected.

Heretofore the thread tension has been generally implemented only with respect to the upper thread because it is easy. The lock stitching sewing machines of this kind are generally provided with a thread tension adjusting device with an operating dial which is operated to adjust the upper thread in accordance to the selected patterns. The lower thread tension is sometimes adjusted by manual adjustment of the bobbin case holding the lower thread.

With respect to the pattern stitching sewing machines, it is necessary to make an adjustment of thread tension in order to provide a most suitable interlocking condition of the upper and lower threads in accordance to the different patterns to be stitched. For the sake of simplicity of explanation reference should be made to FIGS. 1A, 1B and 2A, 2B of the drawings. For example, with respect to the straight stitches as shown in FIG. 1 (A) and (B) the interlocking point "a" of the upper thread 1 and to lower thread 2 is preferable to be positioned about at the center in the thickness of the fabric. On the other hand, with respect to the zigzag stitches as shown in FIG. 2 (A) and (B), the interlocking point "d" is preferable to be positioned at the lower side in the thickness of the fabric as shown in FIG. 2 (B), because the interlocking point "c" positioned at the center in the thickness of fabric in FIG. 2 (A) becames visible at the upper face of the fabric and is undesirable in the pattern stitches. Such a position of interlocking point with respect to the fabric is determined by the relation between the upper and lower thread tensions. Therefore, in order to stitch different patterns in a best condition, it becomes necessary to adjust the tension of the upper thread as well as of the lower thread to properly meet these different patterns. In general, however, the machine operator adjusts only the upper thread for different patterns by means of the upper thread tensioning device, and scarcely adjusts the lower thread tension, because the adjustment of lower thread tension is very difficult and time-consuming.

SUMMARY OF THE INVENTION

The present invention has been provided to eliminate such defects and disadvantages of the prior art. According to the present invention, if the upper thread tension is set to a predetermined value prior to stitching patterns, any patterns will be properly stitched in such a manner that the thread interlocking point is positioned with respect to the thickness of fabric automatically meeting the requirements of the patterns.

Namely the present invention substantially comprises a lower thread tightening element which is operated in synchronism with rotation of the upper drive shaft of the sewing machine in a stitch forming cycle thereof, thereby to draw the lower thread from the bobbin case and tighten the same, and a mechanism for controlling and determining the moving amount of the lower thread tightening element in accordance to a selected pattern, thereby to change the thread interlocking positions in the thickness of the fabric in dependence upon the requirements of the patterns to be stitched.

The other features and advantages of the invention will be apparent from the following description of the preferred embodiments in reference to the attached drawings.

DETAILED DESCRIPTION OF THE INVENTION

Figure 1A:
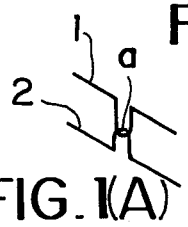
FIG. 1 shows straight look stitches with different thread interlocking positions.
Figure 1B:
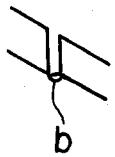
Figure 2A:
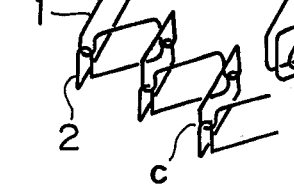
FIG. 2 shows zigzag lock stitches with different thread interlocking positions.
Figure 2B:
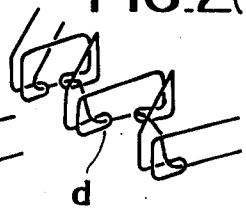
Figure 3:
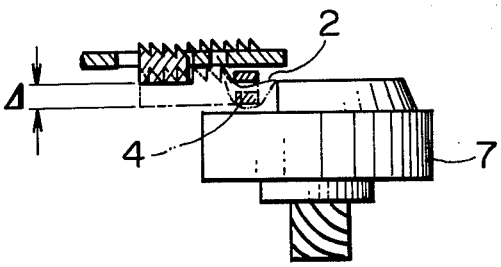
FIG. 3 is a side elevational view of the first embodiment of a thread tightening device of the invention shown partly in section and showing a thread tightening movement amount.
Figure 4:
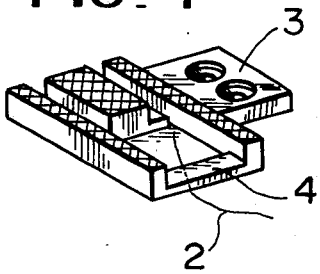
FIG. 4 is a perspective view of the thread tightening device shown in FIG. 3.
Figure 5:
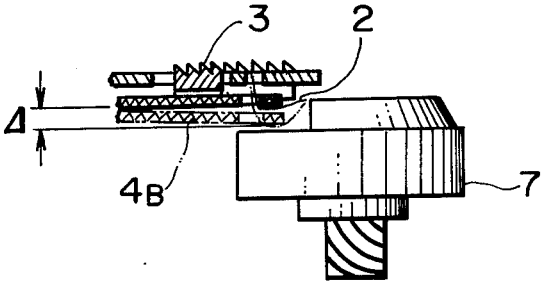
FIG. 5 is a side elevational view of the second embodiment of the thread tightening device of the invention shown partly in section and showing the thread tightening movement amount.
Figure 6:
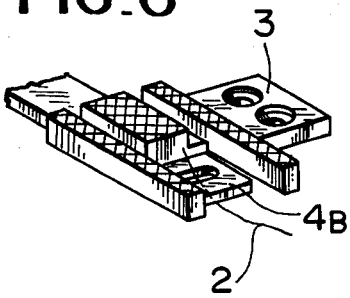
FIG. 6 is a perspective view of the thread tightening device shown in FIG. 5.

Referring to the drawings, FIGS. 3 and 4 illustrate the invention for the horizontal type loop taker. In this invention, as shown in FIGS. 3 and 4, a feed dog is provided with a thread tightening element 4 which is operated together with the feed dog in a combined motion of the vertical and horizontal reciprocating movements as shown by a dotted line in FIG. 3. On the other hand, a thread tightening element 4B is separately provided below the feed dog as shown in FIGS. 5 and 6, which is operated in the same manner with the thread tightening part 4 as shown by a dotted line in FIG. 5. This thread tightening part 4 or element 4B are so operated as to draw the lower thread from the bobbin case and tighten the stitch.

Figure 8:
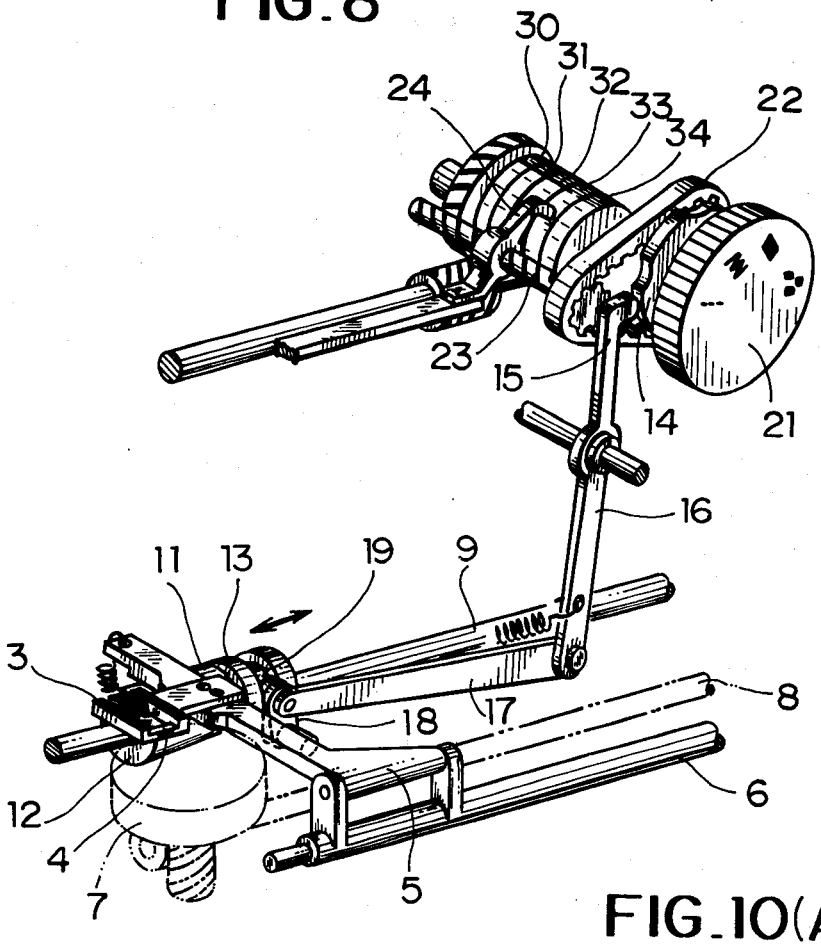
FIG. 8 is a perspective view of a thread tightening control mechanism of the invention applied to the loop-taker of horizontal type.

In reference to FIG. 8 showing a preferred embodiment of the invention this FIG. is applied to a lock stitching sewing machine for producing various stitch patterns including a pattern of straight stitches, the feed dog which has the laterally extended element 4 formed at the lower side thereof transversely of the fabric feeding direction and positioned in a neighbourhood of the loop taker 7 of horizontal type which carries a lower thread bobbin therein and is rotated by a shaft 8 to catch a loop of upper thread to interconnect the same with the lower thread, thereby to form a stitch. The feed dog 3 is secured to a support 5 which is mounted on a rocking shaft 6. The shaft 6 is rocked to reciprocate the feed dog 3 substantially in a horizontal plane. The feed dog 3 is vertically reciprocated by an eccentric cam 11 which is mounted on a shaft 9 and is in engagement with the underside of the feed dog 3. The shaft 9 is driven to rotate the eccentric cam 11 in synchronism with the loop taker drive shaft 8 and the feed dog rocking shaft 6. As shown, the eccentric cam 11 is at one end provided with a groove 19 therearound, and is prevented from rotation relatively to the drive shaft 9, but is displacable in the axial direction thereof.

A manually operated dial 21 is provided on the outside of the machine housing (not shown). A thread tension adjusting cam 14 is arranged within the machine housing coaxially with the dial 21 for rotation therewith. The thread tension adjusting cam 14 is operatively connected to a follower displacing shaft 23 by means of a timing belt 22. The shaft 23 is provided with a spiral groove and carries a follower 24 which is at one end opposite to a group of pattern generating cams 30–34 which are as known rotated at a reduced speed by the upper drive shaft (not shown) of the sewing machine. The other end of the follower 24 is operatively connected to the needle bar to transmit to the latter the control movements of the pattern generating cams 30–34. A lever 16 is at the intermediate part thereof turnably mounted on the machine housing. The lever 16 is provided with an upper follower end 15 which is in engagement with the thread tension adjusting cam 14. The lever 16 has one end connected to the follower end 15 and the other end connected to a crank 18 which is turnably mounted to the machine housing and is in engagement with the groove 19 of the eccentric cam 11 as shown.

Figure 10A:
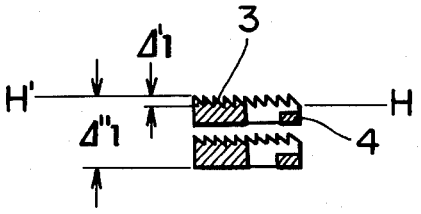
FIGS. 10A and 10B show elevational views partly in section of the thread tightening device of the first embodiment controlled by an eccentric cam.
Figure 9:
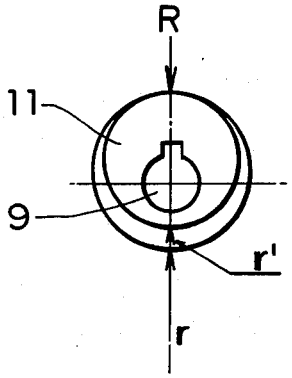
FIG. 9 is a side elevational view of an eccentric cam controlling the vertical reciprocating movement of the thread tightening device.
Figure 10B:
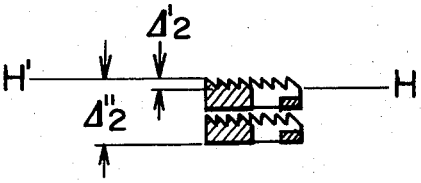

As shown in FIGS. 8 and 9, the eccentric cam 11 is formed with a constant maximum, radius R extended axially from one end 12 towards the other end 13, and is formed with minimum radiuses progressively reduced axially from "r" to "r" extended from the one end 12 towards the other end 13 with the requirements of the patterns to be switched. Therefore, if the eccentric cam 11 is more displaced in the rightward direction in FIG. 8, smaller is the vertical reciprocating movement of the feed dog 3 with the laterally extending element 4 as would be understood from the comparison between the movements $\Delta''_1$ and $\Delta''_2$ while remained unchanged is the vertical reciprocating amount $\Delta'_1$ and $\Delta'_2$ of the feed dog 3 from the needle plate H to the maximum upper limit H' as shown in FIG. 10 (A) and (B). Therefore, if the pattern generating cams 30–34 are sequentially arranged in correspondence to the respective eccentricities of the eccentric cam 11, each of the patterns is formed with the stitches of a predetermined thread interlocking point specifically positioned in thickness of the fabric. Such specific stitches are automatically obtained at the time of pattern selection by manual operation of the dial 21 for displacing the follower 24 along the pattern cams 30–34 and at the same time axially displacing the eccentric cam 11 by way of the thread tension adjusting cam 14 and the transmission linkage 16, 17, 18. Thus according to the invention, a selected pattern is automatically accompanied by adjustment of the vertical reciprocating movement amount of the feed dog 3 by means of the eccentric cam 11. As the result, the element 4 of the feed dog 3 draws a predetermined amount of lower thread from the bobbin and tighten the formed stitch in each cycle of stitch forming operation of the sewing machine in accordance to the requirement of the selected pattern.

Figure 11:
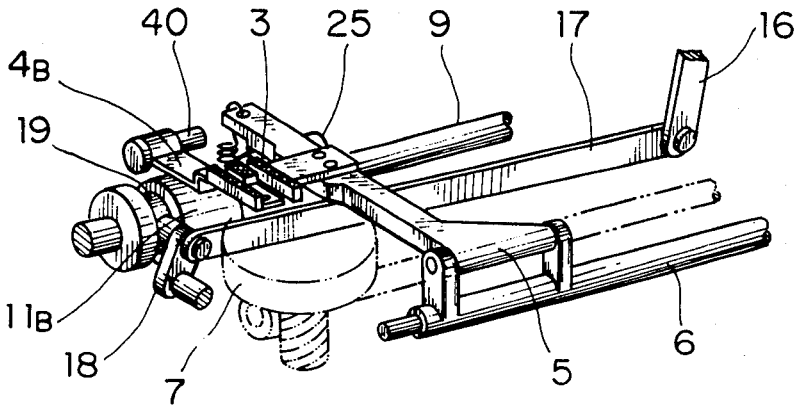
FIG. 11 is a perspective view of the second embodiment of the invention.

FIGS. 5, 6 and 11 show another embodiment of the invention, in which a thread tightening element 4B is provided separately from the feed dog 3. As shown, the thread tightening element 4B is arranged below the feed dog 3 and is pivotally mounted to the machine housing (not shown) by means of a pin 40. According to this embodiment, the eccentric cam 11B only influences the vertical reciprocating movement of the thread tightening element 4B, and the vertical reciprocating movement of the feed dog 3 is constantly controlled by another cam 25 as known. The vertical reciprocating movement of thread tightening element 4B is controlled independently of that of the feed dog 3 in accordance to a selected pattern by operating the dial 21 in the same manner with the first embodiment. In this embodiment, it is necessary to normally bias the element 4B in the downward direction by a spring.

Figure 12:
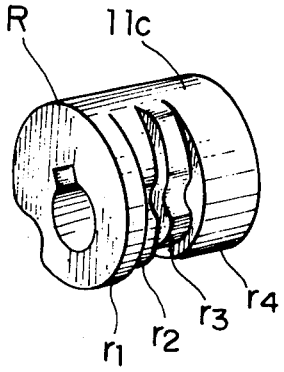
FIG. 12 is a perspective view of an eccentric cam of still another embodiment.

FIG. 12 shows an eccentric cam **11*c* of another embodiment. As shown, the eccentric cam 11*c* is formed with a constant maximum radius R extended axially from one end to the other end thereof, and the eccentric part of the cam 11*c* is axially divided to provide the minimum radiuses $r \sim r_n$ in correspondence to the pattern generating cams 30–34**, for example.

Figure 13:
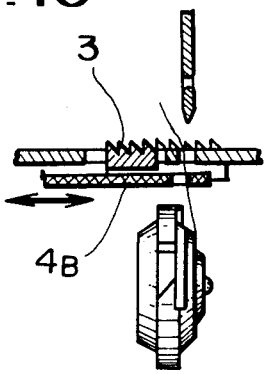
FIG. 13 is a side elevational view shown partly in section of the invention applied to the loop taker of vertical type.

FIG. 13 shows still another embodiment of the invention, in which the thread thightening element 4B of the second embodiment is applied to a sewing machine with a loop taker of vertical type. In this embodiment, in view of the type of loop taker, it becomes necessary to reciprocate the element 4B in a horizontal plane in the fabric feeding direction.

Operation of the invention is as follows:

If the dial 21 is rotated and set to a desired pattern, the thread tension adjusting cam 14 and the spirally grooved shaft 23 are timingly rotated. As the result, the follower 24 is displaced axially to one of the pattern cams 30–34 and engaged therewith, so that the rotational movement of the selected cam may be transmitted to the needle bar (not shown), while the thread tension adjusting cam 14 operates the transmission linkage 16, 17, 18 to axially displace the eccentric cam 11 under the feed dog 13 in accordance to the selected pattern cam. Thus as the sewing machine is driven, the pattern generating cams 30–34 are rotated at a reduced speed, and the selected one of the cams controls the joging movement of the needle, while the shaft 9 is rotated together with the eccentric cam 11 by the loop taker drive shaft 8 and the shaft 6 reciprocates the feed dog 3 in a horizontal plane. Thus the vertical reciprocating movement of the feed dog 3 is adjusted to the requirement of the selected pattern. Therefore the thread tightening element 4 draws a predetermined amount of the lower thread from the bobbin and tighten the stitch as it is formed, so that the threads of the stitch may be interlocked and tightened at a predetermined position in the thickness of the fabric in accordance to the requirement of the selected pattern.

Figure 7:
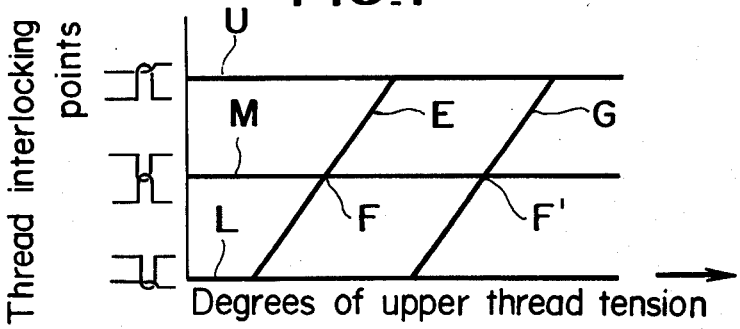
FIG. 7 is a diagramatic view of relations between the thread interlocking positions and the thread tensions.

FIG. 7 shows the relation between the thread interlocking points and the thread tensions, in which the thread interlocking positions are shown vertically and the degrees of upper thread tension are shown laterally. Provided that the character U denotes the upper face of a fabric, the character M denotes the center at which two sheets of fabrics are attached together, and the character L denotes the lowest face of the fabric, the inclined line E shows that the tensions of the upper and lower threads are weak, and the inclined line G shows that the tensions of the upper and lower threads are strong.

Therefore in this case, the proper thread interlocking positions are obtained at the intersections F and F′ respectively. The inclined lines E and G also indicate the amounts of lower thread to be drawn out. This drawn out amount is determined by the stroke Δ of the lower thread tightening element 4 or element 4B shown in FIG. 3 or 5. If the stroke of the element 4 or element 4B is larger, the upper and lower threads are more tightened, and a so tightened proper thread interlocking point is obtained. According to the invention, the stroke Δ of the lower thread tightening part 4 or element 4B is varied in accordance to each of different patterns to meet the stitch forming requirements of each selected pattern.

We claim:

1. In a sewing machine adapted to produce zigzag stitches and straight stitches and having a main shaft adapted to vertically reciprocate a needle bar with a needle carrying an upper thread and arranged to penetrate a fabric to be sewn, a loop taker carrying a lower thread and adapted to catch a loop of the upper thread formed at the needle during the vertical reciprocating movement thereof, a drive shaft operatively connected to the main shaft for driving the loop taker, a feed dog disposed above the loop taker and adapted to transport the fabric, and a thread tightening device for tightening at least one of the upper thread and the lower thread, a combination comprising a group of pattern cams operatively connected to the main shaft to be rotated at a reduced speed for controlling the needle positions; pattern cam selecting means including at least one follower adapted to engage a selected one of the pattern cams; means for operatively connecting the selected pattern cam to the needle bar; means including a rockingly movable shaft operated in a timed relation with the main shaft to reciprocate the feed dog in a horizontal plane; means including a rotational shaft rotated in association with the main shaft to vertically reciprocate the feed dog; lower thread tightening means including an element vertically reciprocated in a timed relation with the feed dog, said element engaging the lower thread during the stitching operation of the sewing machine to draw a predetermined amount of the lower thread and tighten the stitch to be formed; and control means for controlling the vertical reciprocating movement of said element to supply a predetermined amount of the lower thread in accordance with a needle position, during the zigzag as well as the straight stitching operation of the sewing machine.

2. In a sewing machine adapted to produce zigzag and straight stitches and having a main shaft adapted to vertically reciprocate a needle bar with a needle carrying an upper thread and arranged to penetrate a fabric to be sewn, a loop taker carrying a lower thread and adapted to catch a loop of the upper thread formed at the needle during the vertical reciprocating movement thereof, a drive shaft operatively connected to the main shaft for driving the loop taker, a feed dog disposed above the loop taker and adapted to transport the fabric, and a thread tightening device for tightening at least one of the upper thread and the lower thread, a combination comprising a group of pattern cams operatively connected to the main shaft to be rotated at a reduced speed for controlling the needle positions; pattern cam selecting means including at least one follower adapted to engage a selected one of the pattern cams; means for operatively connecting the selected pattern cam to the needle bar; means including a rockingly movable shaft operated in a timed relation with the main shaft to reciprocate the feed dog in a horizontal plane; means including a rotational shaft rotated in association with the main shaft to vertically reciprocate the feed dog; lower thread tightening means including an element arranged below the feed dog and vertically reciprocated in a timed relation with the feed dog, said element engaging the lower thread during the stitching operation of the sewing machine to draw a predetermined amount of the lower thread and tighten the stitch to be formed; and control means for controlling the vertical reciprocating movement of said element, said control means being accessible for operating from outside of the sewing machine and operated to supply a predetermined amount of the lower thread in accordance with a needle position, during the zigzag and the straight stitching operation of the sewing machine.

3. The sewing machine as defined in claim 1, wherein said control means include a control cam operatively connected to said rotational shaft to be slidably displaced thereby.

4. The sewing machine as defined in claim 3, further including thread tension adjusting means including an adjusting cam with parts corresponding to said pattern cams and operatively connected with said pattern cam selecting means, a dial to positively set in a timed relation said adjusting cam with the selected pattern cam, and transmission means including a follower engaging said adjusting cam, links operatively connected to said control cam, said links displacing said control cam axially relatively to said rockingly movable shaft in response to a set position of said adjusting cam.

5. The sewing machine of claim 4, wherein said element is integral with the feed dog.

6. The sewing machine of claim 4, wherein said element is arranged separately from the feed dog.

7. The sewing machine of claim 4, wherein said control cam has a first axially extended portion and a second axially extended portion, said first axially extended portion having a maximum radius permanently extended from one end of said first portion to the other end thereof, said second portion being formed with the minimum radii progressively reduced in the axial direction in accordance with respective pattern cams.

8. The sewing machine of claim 7, wherein said second portion is an integral part with said first portion.

9. The sewing machine of claim 7, wherein said second portion is subdivided into a plurality of parts each having a minimal radius corresponding to the respective pattern cam.

10. The sewing machine of claim 6, wherein controlling means further comprising an additional cam for constantly controlling the vertical movement of the feed dog, said control cam being arranged for controlling the vertifal movement of said element which is arranged to be vertically reciprocated in a timed relation with the feed dog independently from the feed dog in accordance with the selected pattern cam.

* * * * *